US009422744B2

(12) United States Patent
Lin

(10) Patent No.: US 9,422,744 B2
(45) Date of Patent: Aug. 23, 2016

(54) BURGLARPROOF PRIMARY-SECONDARY ROW SHEET LOCK

(71) Applicant: Xiamen Make Security Technology Co., Ltd., Xiamen (CN)

(72) Inventor: Shaolian Lin, Xiamen (CN)

(73) Assignee: XIAMEN MAKE SECURITY TECHNOLOGY CO., LTD., Xiamen, Fujian (CN)

( * ) Notice: Subject to any disclaimer, the term of this patent is extended or adjusted under 35 U.S.C. 154(b) by 0 days.

(21) Appl. No.: 14/893,937

(22) PCT Filed: Aug. 20, 2013

(86) PCT No.: PCT/CN2013/081884

§ 371 (c)(1),
(2) Date: Nov. 25, 2015

(87) PCT Pub. No.: WO2015/024202

PCT Pub. Date: Feb. 26, 2015

(65) Prior Publication Data

US 2016/0123038 A1 May 5, 2016

(51) Int. Cl.

| | |
|---|---|
| ***E05B 29/06*** | (2006.01) |
| ***E05B 29/00*** | (2006.01) |
| ***E05B 19/00*** | (2006.01) |

(52) U.S. Cl.

CPC ..... *E05B 29/0033* (2013.01); *E05B 19/0017* (2013.01); *E05B 29/00* (2013.01); *E05B 29/0053* (2013.01); *E05B 29/0066* (2013.01); *Y10T 70/7599* (2015.04); *Y10T 70/7616* (2015.04); *Y10T 70/7881* (2015.04)

(58) Field of Classification Search

CPC ..... E05B 29/0033; E05B 19/0017; E05B 29/0066; E05B 29/00; E05B 29/0053; Y10T 70/7881; Y10T 70/7599; Y10T 70/7616

USPC ..... 70/359, 417, 409, 492, 495, 377, 496

See application file for complete search history.

(56) References Cited

U.S. PATENT DOCUMENTS

| | | | | | |
|---|---|---|---|---|---|
| 1,422,519 | A * | 7/1922 | Augenbraun | E05B 15/1614 | 70/375 |
| 2,024,441 | A * | 12/1935 | Fitz Gerald | E05B 29/00 | 70/377 |
| 2,059,129 | A * | 10/1936 | Maxwell | E05B 15/1614 | 70/372 |
| 2,949,762 | A * | 8/1960 | Johnstone | E05B 29/00 | 70/495 |
| 3,319,443 | A * | 5/1967 | Perlick | E05B 17/04 | 70/373 |
| 3,410,123 | A * | 11/1968 | Jacobi | E05B 29/00 | 70/366 |
| 3,735,614 | A * | 5/1973 | Keller-Volper | E05B 29/00 | 70/377 |
| 3,999,413 | A * | 12/1976 | Raymond | E05B 29/004 | 70/377 |

(Continued)

*Primary Examiner* — Lloyd Gall
(74) *Attorney, Agent, or Firm* — Leong C. Lei

(57) ABSTRACT

A burglarproof primary-secondary row sheet lock includes an outer cylinder in which a cylindrical chamber that receives the insertion of a plug and a latch trough are formed. The plug includes row sheet receiving slots, a latch opening, a key way, and a lock bolt. The secondary row sheets each have a side edge in which a first latch notch is formed. The primary row sheets are each formed with a secondary row sheet channel and a second latch notch. The primary row sheets are set in the row sheet receiving slots and the secondary row sheets are received in the secondary row sheet channels. The closure plates cover the row sheet receiving slots with sheet return springs arranged between the closure plates and the primary and secondary row sheets. The latch is received in the latch opening and latch return springs are arranged between the plug and the latch.

7 Claims, 2 Drawing Sheets

(56) References Cited

U.S. PATENT DOCUMENTS 4,750,342 A * 6/1988 Nakai ..... E05B 29/00 70/377
4,966,021 A * 10/1990 Boag ..... E05B 29/004 70/377
4,977,767 A * 12/1990 Prunbauer ..... E05B 27/0082 70/406
5,222,383 A * 6/1993 Fann ..... E05B 27/0021 70/358
5,826,451 A * 10/1998 Cook ..... E05B 29/00 70/358
8,347,680 B2 * 1/2013 Widen ..... E05B 27/0017 70/378
2003/0154752 A1 * 8/2003 Price ..... E05B 15/1614 70/358
2009/0188286 A1 * 7/2009 Farrenkothen ..... E05B 29/00 70/351
2011/0041577 A1 * 2/2011 Zhang ..... E05B 27/005 70/384

* cited by examiner

BURGLARPROOF PRIMARY-SECONDARY ROW SHEET LOCK

(a) TECHNICAL FIELD OF THE INVENTION

The present invention relates generally to the technical field locks, and more particularly to an improved design of a burglarproof primary-secondary row sheet lock.

(b) DESCRIPTION OF THE PRIOR ART

A lock is a device that provides a function of closure and generally comprises a lock and a key, wherein the key can be operated to unlock the lock so as to achieve an effect of management and control. In the modern technology, locks are classified as drawer locks, pin tumbler locks, mortise locks, cylindrical locks, and electronic locks. With the continuous upgrading of living standard of people, the consciousness of security is being intensified so that the demand for high-end security-purpose locks is continuously increased. However, the known locks cannot satisfy the needs of consumers.

In view of this, the present inventor develops a primary-secondary row sheet lock that offers an improved effect of burglary resistance and, as such, the present invention is provided.

SUMMARY OF THE INVENTION

An object of the present invention is to provide a burglarproof primary-secondary row sheet lock, which greatly enhances security of locks.

To achieve the above object, the present invention provides the following technical solution:

A burglarproof primary-secondary row sheet lock comprises a lock body and a key. The lock body comprises an outer cylinder, a plug, closure plates, secondary row sheets, primary row sheets, sheet return springs, a latch and, latch return springs. The outer cylinder comprises a cylindrical chamber formed therein. The cylindrical chamber has an inside surface having a latch trough formed therein. The plug is in the form of a cylinder and is received in the cylindrical chamber of the outer cylinder. The plug comprises row sheet receiving slots formed therein and also comprises a latch opening formed therein at one side of the row sheet receiving slots to correspond to the latch trough of the outer cylinder and extending to and in communication with the row sheet receiving slots. The plug has a front end in which a key way is formed and extending across and through the row sheet receiving slots. The plug has a rear end on which a lock bolt is formed and located outside the outer cylinder. The secondary row sheets each have a side edge in which a first latch notch is formed. The primary row sheets each comprise a secondary row sheet channel formed therein to extend completely therethrough in an up-down direction. The primary row sheets each have a side edge in which a second latch notch is formed to extend through the secondary row sheet channel. The primary row sheets are respectively set in the row sheet receiving slots. The secondary row sheets are respectively received in the secondary row sheet channels. The closure plates are set on and cover end openings of the row sheet receiving slots. Each of the sheet return springs is arranged between the closure plates and each of the secondary row sheets and the primary row sheets. The latch is received in the latch opening. The latch return springs are arranged between the latch and the plug. The key comprises a key blade insertable into the key way. The key blade comprises side cuts and central cuts formed therein to respectively lift up the secondary row sheets and the primary row sheets so as to have the first latch notches and the second latch notches aligned with the latch opening.

The secondary row sheets each comprise a first fake notch formed therein.

The primary row sheets each comprise a second fake notch formed therein.

The secondary row sheets and the primary row sheets each comprise a push tab formed thereon. The plug comprises spring recesses formed therein. The sheet return springs are respectively set in the spring recesses with an end of each of the sheet return springs supported on the closure plates and an opposite end abutting the push tab.

The plug is provided with an insertion opening formed in a circumference of a front end portion thereof and a drilling resistant plate is received in the insertion opening.

The latch trough is in the form of an arc groove and the latch has an outside surface that is in the form of an arc surface.

The key blade of the key has a front end that forms a guide-in surface.

Based on the above technical solution, without insertion of a matched key, the first latch notches of the secondary row sheets and the second latch notches of the primary row sheets are not in alignment with the latch opening so that the latch is prevented from sliding into the first latch notches and the second latch notches and is kept in the latch trough so as to hinder relative rotation of the plug with respect to the outer cylinder, whereby unlocking is not possible. With a matched key inserted, the first latch notches of the secondary row sheets and the second latch notches of the primary row sheets are all caused to be in alignment with the latch opening, allowing the latch to first slide into the second latch notches and then sliding into the first latch notches so as to get out of the latch trough and thus releasing the locking condition, whereby the plug is allowed to rotate relative to the outer cylinder and unlocking is now possible.

The number of combinations of key cuts that is available with the present invention is M to the Nth power, where M is the number of types of secondary row sheets and primary row sheets (different stages) and N is the total number of the secondary row sheets and the primary row sheets. Compared to a prior art lock, the number of combinations of the cuts of the present invention can be as high as tens of millions and this greatly improves lock security performance.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
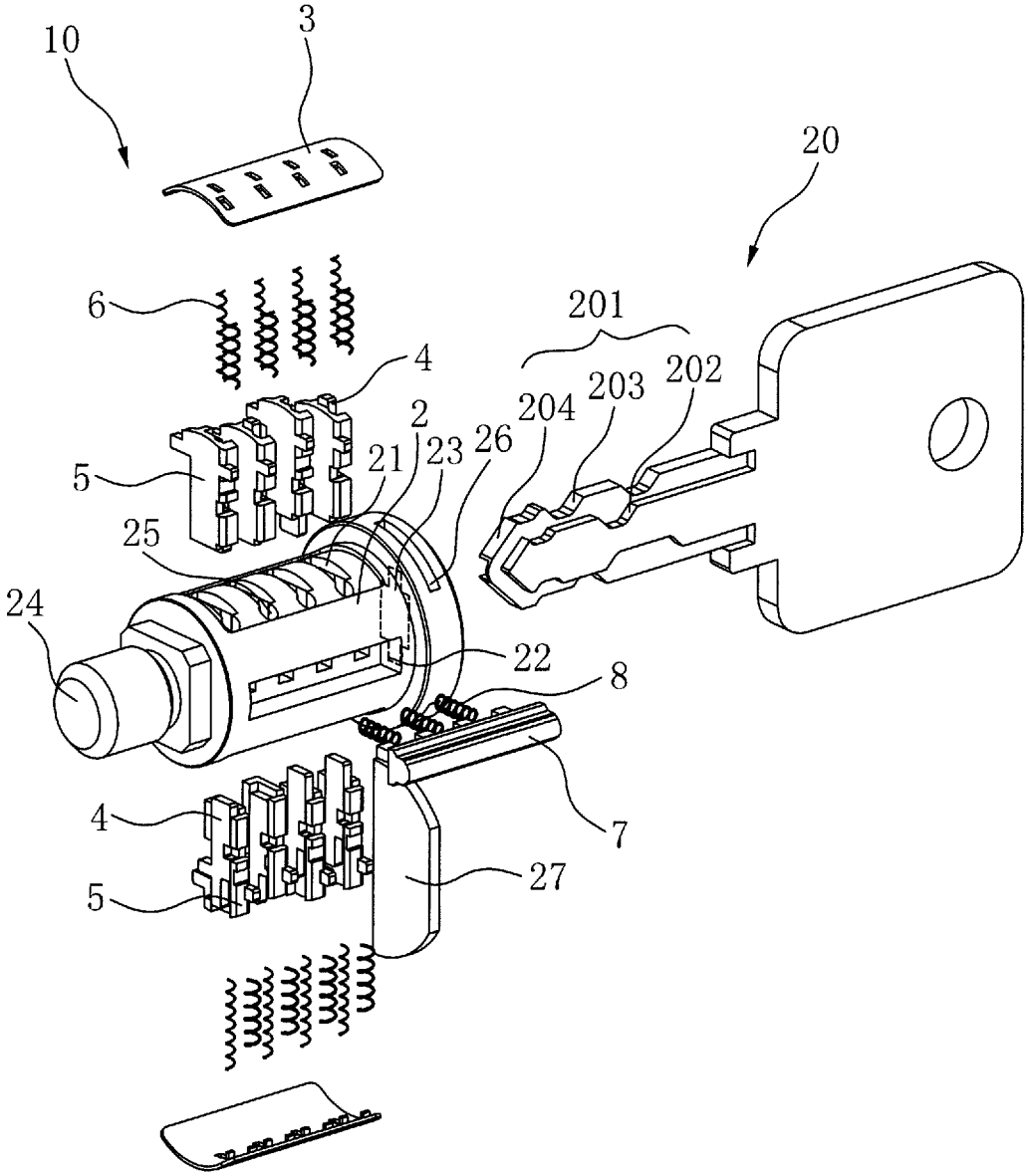
FIG. 1 is an exploded view of the present invention (with an outer cylinder omitted).
Figure 2:
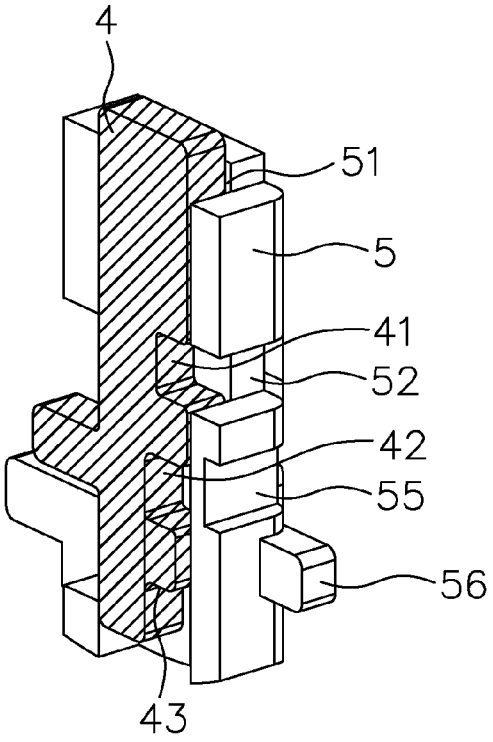
FIG. 2 is a schematic view illustrating spatial relationship of the combination of a secondary row sheets and a primary row sheet of the present invention.
Figure 3:
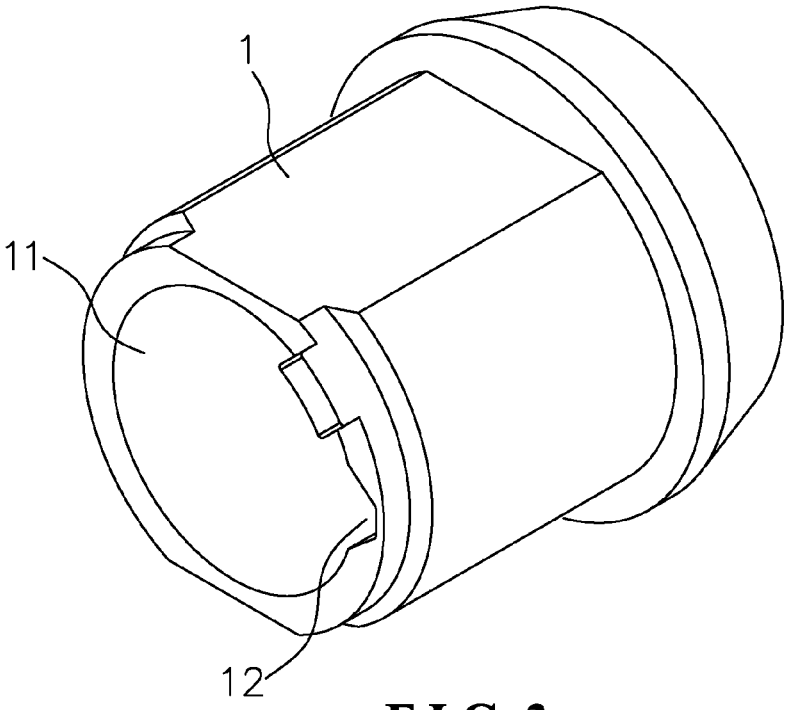
FIG. 3 is a perspective view showing the outer cylinder of the present invention.

As shown in FIGS. 1-3, the present invention provides a burglarproof primary-secondary row sheet lock, which comprises a lock body 10 and a key 20.

The lock body 10 comprises an outer cylinder 1, a plug 2, closure plates 3, secondary row sheets 4, primary row sheets 5, sheet return springs 6, a latch 7, and latch return springs 8.

The outer cylinder 1 comprises a cylindrical chamber 11 formed therein. The cylindrical chamber 11 has an inside surface having a latch trough 12 formed therein.

The plug 2 is in the form of a cylinder. The plug 2 is inserted in the cylindrical chamber 11 of the outer cylinder 1. The plug 2 comprises row sheet receiving slots 21 formed therein and is formed, at one side of the row sheet receiving slots 21, with a latch opening 22 corresponding to the latch trough 12 of the outer cylinder 1 and extending to and in communication with the row sheet receiving slots 21. The plug 2 has a front end in which a key way 23 is formed and extending across and through the row sheet receiving slots 21. The plug 2 has a rear end on which a lock bolt 24 is formed in such a way that the lock bolt 24 is located outside the outer cylinder 1.

The closure plates 3 are set on and cover end openings of the row sheet receiving slots 21.

The secondary row sheets 4 each have a side edge in which a first latch notch 41 is formed.

The primary row sheets 5 each comprise a secondary row sheet channel 51 formed therein to extend completely therethrough in an up-down direction. The primary row sheets 5 each have a side edge in which a second latch notch 52 is formed to extend through the secondary row sheet channel 51. A number of the primary row sheets 5 is provided and respectively set in the row sheet receiving slots 21. The secondary row sheets 4 are respectively inserted into the secondary row sheet channels 51. The number of the secondary row sheets 4 and the primary row sheets 5 may be determined according to design requirements and is not limited to the illustration of the text and drawings presented herein.

The sheet return springs 6 are arranged between the closure plates 3 and the secondary row sheets 4 and the primary row sheets 5. For easy installation and replacement, in the instant embodiment, each of the secondary row sheets 4 and each of the primary row sheets 5 are respectively formed with a push tab 43 and 56, while the plug 2 is formed with spring recesses 25 that are located in the row sheet receiving slots 21 of the plug 2, so that the sheet return springs 6 are respectively set in the spring recesses 25 and thus located in the row sheet receiving slots 21 with an end of each of the sheet return springs 6 supported on the closure plates 3 and an opposite end abutting the push tab 43 or 56.

The latch 7 is received in the latch opening 22. For easy and smooth movement of the latch 7 in an unlocking operation, in the instant embodiment, the latch 7 has an outside surface that is made in the form of an arc surface, while the latch trough 12 is in the form of an arc groove.

The latch return springs 8 are arranged between the latch 7 and the plug 2.

The key 20 comprises a key blade 201. The key blade 201 is insertable into the key way 23. The key blade 201 comprises side cuts 202 and central cuts 203 formed therein. The side cuts 202 are arranged to lift up the secondary row sheets 4, while the central cuts 203 lifts up the primary row sheets 5, so that the first latch notches 41 and the second latch notches 52 are set in alignment with the latch opening 22 to allow for rotation of the plug 2 in conducting an unlocking operation. To ease the insertion of the key blade 201 to mate the secondary row sheets 4 and the primary row sheets 5, in the instant embodiment, the key blade 201 has a front end that forms a guide-in surface 204.

To further improve the security property of the lock and to prevent undesired unlocking through burglar skills, in the instant embodiment, the secondary row sheets 4 each comprise a first fake notch 42 formed therein and the primary row sheets 5 each comprise a second fake notch 55 formed therein.

To improve the resistance of the plug 2 against drilling, in the instant embodiment, the plug 2 is provided with an insertion opening 26 formed in a circumference of a front end portion thereof and a drilling resistant plate 27 is received in the insertion opening 26.

After installation of the lock body 10 according to the present invention, the secondary row sheets 4 and the primary row sheets 5 are acted upon by the sheet return springs 6 to be received down into the row sheet receiving slots 21 with the first latch notches 41 of the secondary row sheets 4 and the second latch notches 52 of the primary row sheets 5 being not in alignment with the latch opening 22. The latch 7 is thus kept in the latch trough 12 as being blocked by the secondary row sheets 4 and the primary row sheets 5 so that the plug 2 is prevented from rotating relative to the outer cylinder 1. This provides an effect of locking.

When a non-matched key is inserted, the cuts of the key cannot lift the secondary row sheets 4 and the primary row sheets 5 up to such a position where the first latch notches 41 of the secondary row sheets 4 and the second latch notches 52 of the primary row sheets 5 are all in alignment with the latch opening 22 (wherein at least some of the first latch notch 41 and the second latch notch 52 are not in alignment with the latch opening 22 or all the first latch notches 41 and the second latch notches 52 are not in alignment with the latch opening 22) and thus, the latch 7 is still kept in the latch trough 12 and the rotation of the plug 2 relative to the outer cylinder 1 is still prevented, whereby the key cannot be operated to unlock and the effect of locking is maintained.

When the key blade 201 of a matched key 20 is inserted into the key way 23, the side cuts 202 lift up the secondary row sheets 4 and the central cuts 203 lift up the primary row sheets 5 so that the first latch notches 41 and the second latch notches 52 are all in alignment with the latch opening 22, whereby the key 20 is allowed to operate to rotate the plug 2 and the latch 7 is forced by the inside surface of the outer cylinder 1 to first slide into the second latch notches 52 and then further slide into the first latch notches 41 to eventually get out of the latch trough 12 completely and thus releasing the locking condition. Subsequent operation of the key 20 to rotate the plug 2 would cause the plug 2 to rotate relative to the outer cylinder 1 to drive the lock bolt 24 to get out of a locking hole (which is formed in a doorjamb or a device to be locked). This provides an effect of unlocking.

According to the present invention, the maximum number of combinations of key cuts available is M to the Nth power, where M is the number of types of secondary row sheets and primary row sheets (different stages) and N in the total number of the secondary row sheets and the primary row sheets. In the instant embodiment, N is 16, and M can be determined according to design requirement. The number of the combinations of the cuts can be as high as tens of millions and this greatly improves lock security performance.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A burglarproof primary-secondary row sheet lock, characterized by comprising a lock body and a key, wherein the lock body comprises an outer cylinder, a plug, closure plates, secondary row sheets, primary row sheets, sheet return springs, a latch and, latch return springs; the outer cylinder comprises a cylindrical chamber formed therein, the cylindrical chamber having an inside surface having a latch trough formed therein; the plug is in the form of a cylinder and is received in the cylindrical chamber of the outer cylinder, the plug comprising row sheet receiving slots formed therein and also comprising a latch opening formed therein at one side of the row sheet receiving slots to correspond to the latch trough of the outer cylinder and extending to and in communication with the row sheet receiving slots, the plug having a front end in which a key way is formed and extending across and through the row sheet receiving slots, the plug having a rear end on which a lock bolt is formed and located outside the outer cylinder; the secondary row sheets each have a side edge in which a first latch notch is formed; the primary row sheets each comprise a secondary row sheet channel formed therein to extend completely therethrough in an up-down direction, the primary row sheets each having a side edge in which a second latch notch is formed to extend through the secondary row sheet channel, the primary row sheets being respectively set in the row sheet receiving slots, the secondary row sheets being respectively received in the secondary row sheet channels of the primary row sheets; the closure plates are set on and cover end openings of the row sheet receiving slots, each of the sheet return springs being arranged between the closure plates and each of the secondary row sheets and the primary row sheets; the latch is received in the latch opening, the latch return springs being arranged between the latch and the plug; and the key comprises a key blade insertable into the key way, the key blade comprising side cuts and central cuts formed therein to respectively lift up the secondary row sheets and the primary row sheets so as to have the first latch notches and the second latch notches aligned with the latch opening.

2. The burglarproof primary-secondary row sheet lock according to claim 1, characterized in that the secondary row sheets each comprise a first fake notch formed therein.

3. The burglarproof primary-secondary row sheet lock according to claim 1, characterized in that the primary row sheets each comprise a second fake notch formed therein.

4. The burglarproof primary-secondary row sheet lock according to claim 1, characterized in that the secondary row sheets and the primary row sheets each comprise a push tab formed thereon, the plug comprising spring recesses formed therein such that the spring recesses are located in the row sheet receiving slots, the sheet return springs being respectively set in the spring recesses and thus received in the row sheet receiving slots such that the sheet return springs received in each of the row sheet receiving slots respectively correspond to the primary row sheets received in the row sheet receiving slot and the secondary row sheets received in the secondary row sheet channels of the primary row sheets with an end of each of the sheet return springs supported on the closure plates and an opposite end abutting the push tab of each of the primary and secondary row sheets.

5. The burglarproof primary-secondary row sheet lock according to claim 1, characterized in that the plug is provided with an insertion opening formed in a circumference of a front end portion thereof and a drilling resistant plate is received in the insertion opening.

6. The burglarproof primary-secondary row sheet lock according to claim 1, characterized in that the latch trough is in the form of an arc groove and the latch has an outside surface that is in the form of an arc surface.

7. The burglarproof primary-secondary row sheet lock according to claim 1, characterized in that the key blade of the key has a front end that forms a guide-in surface.

* * * * *